United States Patent [19]

Streubel

[11] 4,433,716

[45] Feb. 28, 1984

[54] ROLLER APRON FOR THE WITHDRAWAL AND/OR STRAIGHTENING REGION OF A CONTINUOUS CASTING INSTALLATION FOR STRANDS

[75] Inventor: Hans Streubel, Erkrath, Fed. Rep. of Germany

[73] Assignee: SMS Schloemann-Siemag Aktiengesellschaft, Düsseldorf, Fed. Rep. of Germany

[21] Appl. No.: 345,542

[22] Filed: Feb. 3, 1982

[30] Foreign Application Priority Data

Feb. 21, 1981 [DE] Fed. Rep. of Germany ..... 3106531

[51] Int. Cl.[3] ..... B22D 11/128

[52] U.S. Cl. ..... 164/448; 164/442

[58] Field of Search ..... 164/441, 442, 447, 448

[56] References Cited

U.S. PATENT DOCUMENTS 3,707,184 12/1972 Burkhardt et al. ..... 164/448

3,963,069 6/1976 Marti et al. ..... 164/448

FOREIGN PATENT DOCUMENTS 982086 2/1965 United Kingdom ..... 164/448

1038169 8/1966 United Kingdom ..... 164/448

*Primary Examiner*—Kuang Y. Lin

*Attorney, Agent, or Firm*—Werner W. Kleeman

[57] ABSTRACT

A roller apron or strand guide arrangement for the withdrawal and/or straightening region of a continuous casting installation for the casting of strands contains two roll tracks subdivided into sections or segments containing at least two rolls for each roll track. The rolls of each track section are mounted upon a respective traverse or yoke, with the one traverse being affixed to a frame and the other traverse is hingedly connected at piston rod heads of stationarily arranged pressurized fluid medium cylinders. The piston rod heads are associated with guides at stands, the guides extending transversely with respect to the roll tracks. The guides are arranged between the roll sections at regions of parting lines between the sections and each roll section at each side of the path of travel of the cast strand possesses two pressurized fluid medium cylinders whose piston rod heads are guided at one side along a respective one of the guides.

6 Claims, 4 Drawing Figures

ROLLER APRON FOR THE WITHDRAWAL AND/OR STRAIGHTENING REGION OF A CONTINUOUS CASTING INSTALLATION FOR STRANDS

BACKGROUND OF THE INVENTION

The present invention relates to a new and improved construction of a roller apron or strand guide arrangement for the withdrawal and/or straightening region of a continuous casting installation for strands.

Generally speaking, the roller apron for the withdrawal and/or straightening region of a continuous casting installation for strands as contemplated by the present invention is of the type comprising two roll or roller tracks which are subdivided into sections or segments, wherein there are provided for each roll track two rolls. The rolls of each track section are mounted upon a respective traverse or yoke, and the one traverse is secured to a frame and the other traverse is hingedly connected to piston rod heads of stationarily arranged pressurized fluid medium cylinders and the piston rod heads are operatively associated with guides at stands, these guides extending transversely to the roll track.

In a prior art straightening machine of a continuous casting installation for strands, for instance as disclosed in German Patent Publication No. 2,023,319 and the corresponding U.S. Pat. No. 3,707,184, granted Dec. 26, 1972, upper and lower traverses or yokes are attached to pivot pins arranged between two roll bearings in the manner of a balance or rocker. Each pivot pin of the upper traverse is secured in a piston rod head of a pressurized fluid medium cylinder arranged in the frame. At the frame there are anchored to both sides of each pressurized fluid medium cylinder two stands or uprights between which there is guided the piston rod head of the pressurized fluid medium cylinder. The upper traverse or yoke is elevationally adjustable in this manner and is pivotable about its center.

This pivotability of the upper traverse with the prior art straightening machine, during a deviation or shifting of the one roll in consequence of the tilting or rocker movement of the other roll, presses into the still plastically deformable strand, so that there are formed localized rolling actions at the cast strand resulting in deviations from its reference or set thickness value. The stands located at the central region of the traverse hinder both the visual and physical access at this location of the continuous casting installation. A design using pivot pins arranged between the roll bearings requires a large spacing of the rolls from one another. A more compact arrangement of the rolls would be associated with appreciable structural modifications and difficulties as concerns maintenance of the equipment. A further shortcoming of the state-of-the-art construction resides in the fact that with an inclined position of the upper traverse there arises an appreciable lateral deflection in the direction of the neighboring traverse or yoke. To prevent abutment of neighboring upper traverses or their rolls or bearings, it is therefore necessary to provide a certain spacing between the traverses or yokes. This constitutes a further reason why with the described prior art construction there cannot be realized a uniform close spacing of the rolls as is needed for modern day continuous casting installations.

SUMMARY OF THE INVENTION

Therefore, with the foregoing in mind it is a primary object of the present invention to provide a new and improved construction of roller apron or strand guide arrangement for the withdrawal and/or straightening region of a continuous casting installation for strands, which is not afflicted with the aforementioned drawbacks and limitations of the prior art constructions.

Another and more specific object of the present invention aims at the provision of a roller apron or stand guide arrangement of the previously mentioned type which enables the realization of a price worthy construction of withdrawal and straightening machine which affords good visual access and physical access to the parts located thereat, and wherein the rolls can be mounted at a uniform small spacing from one another and the traverses or yokes can be arranged compactly in succession.

Still a further significant object of the present invention aims at providing a new and improved construction of roller apron for a continuous casting installation wherein it is possible to cast strands possessing minimum deviations in their thickness.

Yet a further important object of the present invention is to provide a new and improved construction of roller apron for a continuous casting installation where it is possible to realize a uniform small roll spacing while attaining good accessibility to this portion of the equipment for the purpose of carrying out control, adjustment and maintenance operations.

Now in order to implement these and still further objects of the invention, which will become more readily apparent as the description proceeds, the roller apron of the present development is manifested by the features that the guides are arranged at the region of the parting lines between the roll sections and that each section is provided at each side of the strand track or path of travel with two pressurized fluid medium cylinders, the piston rod heads of which are guided at one side along a respective one of the guides.

By virtue of the above design of the roller apron or strand guide arrangement as contemplated by the invention it is possible, as mentioned, to attain a uniform small spacing of the rolls from one another while still affording good accessibility for control, adjustment and maintenance work. By shifting the hinge connection of the piston rod heads at the upper traverses or yokes towards the outside there is increased the pivot radii of the upwardly pivoted or rocked side of the relevant traverse or yoke, so that the curvature of the pivot are produced by the outer edge of the traverse becomes flatter and there is reduced the lateral pivoting-out movement.

The piston rod heads with the pivot pins or bolts connected to the upper traverses or yokes are advantageously arranged approximately at the center between the common axial plane of the rolls and the bearing clamping or attachment plane.

According to a further advantageous feature of the invention spacer elements are arranged at brackets for the purpose of limiting the approach movement of the upper traverse or yoke with respect to the related reference strand track or path of travel. These spacer elements are attached below a traverse plate at the stand-side plates.

To obtain a simple lateral guiding action the traverses or yokes can be provided at both sides with slide blocks or the like, with which there are operatively associated guide ledges or surfaces provided at the stands or uprights.

According to a still further construction of the invention, in the case of traverses having three or more rolls mounted thereat, in each instance the intermediate roll is guided to be movable at the upper traverse or yoke transversely with respect to the strand and can be adjusted by pressurized fluid medium cylinders and the adjustable rolls and/or the oppositely rolls are driven.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the continuous casting installation for the casting of strands has been shown in order to simplify the illustration of the drawings, while enabling those skilled in this technology to readily understand the underlying principles and concepts of the present development.

Figure 1:
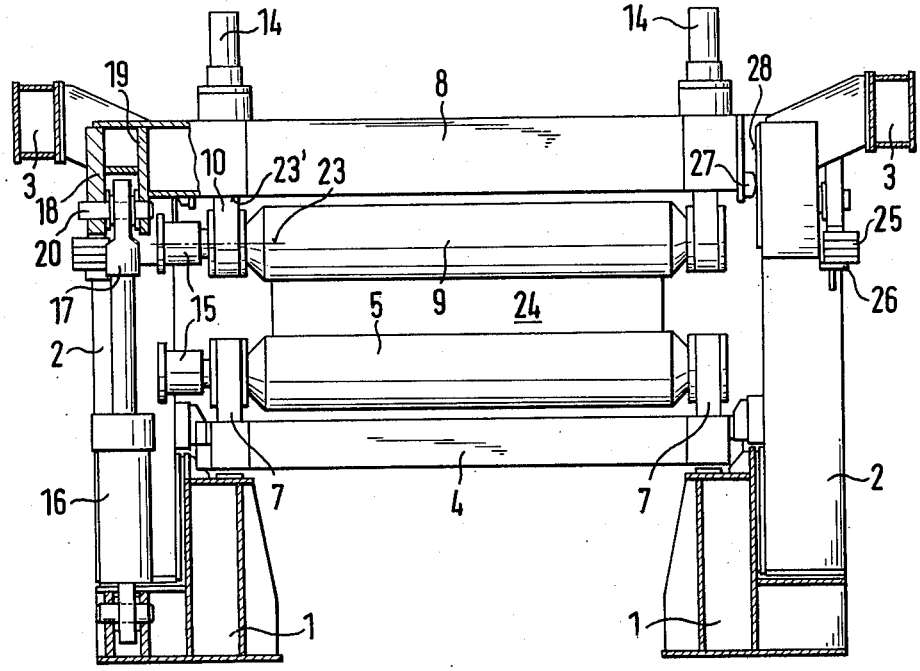
FIG. 1 illustrates in two cross-sectional planes a withdrawing and straightening region of a roller apron or strand guide arrangement of a continuous casting installation and constructed according to the invention.
Figure 2:
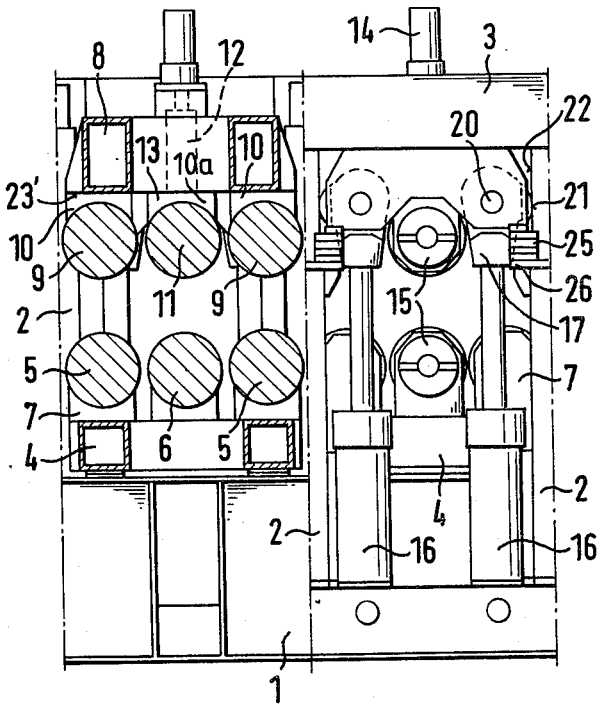
FIG. 2 illustrates in fragmentary side view two sections or segments of the withdrawal and straightening region of the roller apron, wherein the left-hand portion thereof is a side sectional view.

Turning attention now to FIG. 1, it will be seen that in the illustrated exemplary embodiment stands or uprights 2 or equivalent structure are anchored at a frame 1. These stands or uprights 2 are interconnected at their upper end regions by the longitudinally extending supports or carriers 3 arranged at the sides of the frame or frame means 1, as best seen by referring to FIG. 1. Between the stands or uprights 2 there are attached to the frame 1, the lower traverses or yokes 4, upon which there are arranged in each case by means of their bearings 7 two outer rolls or rollers 5 and an intermediate roll 6. At an upper traverse or yoke 8 there are stationarily arranged two outer rolls 9 with their bearings 10 as well as an intermediate or central roll 11 which, however, is adjustably mounted by means of its bearings 13 guided upon the guide pins or plugs 12 or equivalent structure. Drawing in each case through the central region of the uprights or stands 2 are the parting or partition lines 29 between successive traverses or yokes 4 and 8, respectively.

To adjust the bearings 13 there are arranged at each upper traverse or yoke 8 fluid-operated cylinders 14, here in the form of hydraulic cylinders, which when impinged with the pressurized hydraulic fluid medium are capable of pressing the intermediate roll 11 towards a dummy bar of reduced thickness. The lower and upper intermediate rolls 6 and 11 are provided with any suitable coupling elements or flanges 15 for here not particularly illustrated but standard drive spindles, as is well known in this technology.

In order to positionally adjust each of these upper traverses or yokes 8 there are provided four fluid-operated cylinder units 16, here again hydraulic cylinder units, which are anchored at the frame 1. The piston rod heads 17 of the hydraulic cylinders or cylinder units 16 are retained between two webs or brackets 18 and 19 or equivalent structure of the upper traverse 8 by means of the pivot pins or bolts 20. Each piston rod head 17 is laterally provided with a slide surface 21 with which there are operatively associated the guides 22 provided at the related stands or uprights 2. The pivot pins or bolts 20 are arranged such that their lengthwise axes are located approximately centrally between the common axial plane 23 of the roller bearings 10 and the clamping plane or interface 23′ of the bearing housings 10*a* at the related upper traverse or yoke 8.

In order to limit the movement of approach or attack of the upper traverse 8 towards the continuously cast strand 24 there are arranged exchangeable spacer elements 25 upon brackets 26 or the like which are secured at the stands or uprights 2. These spacer elements 25 thus form for the outer webs 18 of the upper traverse or yoke 8 an adjustable stop or impact member.

At each upper traverse 8 there are arranged lateral slide blocks or guide elements 27 or equivalent structure with which there are operatively correlated guide surfaces 28 of the related stands or uprights 2.

Figure 3A:
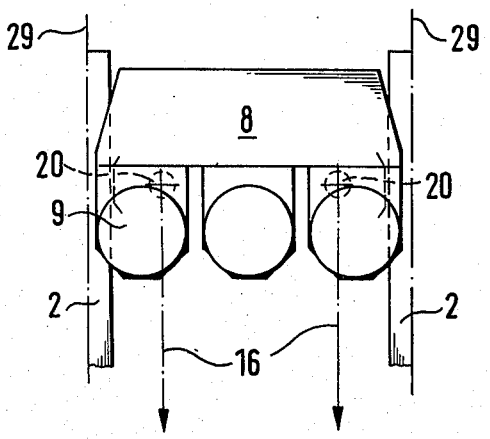
FIGS. 3*a* and 3*b* schematically illustrate an upper traverse or yoke, respectively, in its horizontal position and in a pivoted position.
Figure 3B:
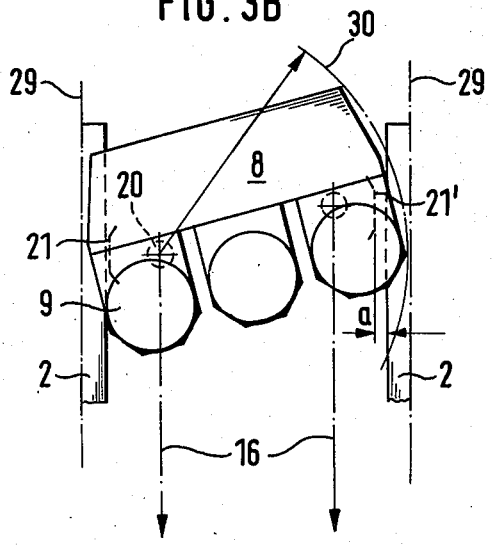

In the event of a strand irregularity or a disturbance the upper traverse or yoke 8 pivots or rocks about two coaxial pivot pins or bolts 20, out of the horizontal position shown in FIG. 3*a*, through the arc or curved path 30 into the inclined position shown in FIG. 3*b*. Consequently, neither the raised side nor the downwardly pivoted side of the upper traverse or yoke 8 moves past the traverse partition lines 29. By virtue of the close arrangement of the traverse partition or separation lines 29 it should be clear that the upper traverses or yokes 8 can be arranged in extremely close adjacent relationship to one another. During pivoting of the upper traverses 8 there is reduced the horizontally measured distance or spacing between the slide or guide surfaces 21 and 21′ arranged at the piston rod heads 17, so that for instance the slide or guide surfaces 21 take up the horizontal force and the oppositely situated slide surfaces 21′ are spaced from their guides 22 by the amount a.

While there are shown and described present preferred embodiments of the invention, it is to be distinctly understood that the invention is not limited thereto, but may be otherwise variously embodied and practiced within the scope of the following claims. Accordingly,

What I claim is:

1. A roller apron for a withdrawal and/or straightening region of a continuous casting installation for the continuous casting of strands moving along a strand path of travel, comprising:

two roll tracks subdivided into sections along partition lines extending transversely relative to said two roll tracks;

each section of each roll track containing at least two rolls;

a respective traverse at which there are mounted the rolls in each section of each one of said two roll tracks;

frame means;

stationary arranged pressurized fluid medium cylinders containing piston rod heads;

one of the traverses in each said section of one of said two roll tracks being affixed to said frame means and the other traverse in each said section of the other one of said two roll tracks defining a movable traverse which is hingedly connected at said piston rod heads of said stationarily arranged pressurized fluid medium cylinders;

stand means containing guides;

said partition lines extending along said stand means;

the piston rod heads being operatively associated with said guides of said stand means;

said guides extending transversely with respect to the related roll track and being arranged at the region of the partition lines between the sections; and each section at each side of the strand path of travel containing two of said pressurized fluid medium cylinders, the piston rod heads of which are guided at one side thereof along a related one of said guides.

2. The roller apron as defined in claim 1, further including:

roller bearings through which a common axial plane extends and which are each mounted in a respective bearing housing;

said other traverse defines an upper traverse;

pivot bolt means for connecting the piston rod heads with the upper traverse;

said bearing housings being secured to said upper traverse and defining an interface; and said pivot bolt means being located approximately at a central region between said common axial plane of said roller bearings and said interface.

3. The roller apron as defined in claim 2, further including:

spacer elements for limiting the approach movement of the upper traverse towards a predetermined reference strand path of travel;

bracket means at which there are arranged said spacer elements; and said bracket means being attached beneath an outer plate of said upper traverse at the stand means.

4. The roller apron as defined in claim 2, further including:

sliding block means arranged to both sides of each of the upper traverses; and guide surfaces provided at the stands with which operatively coact said sliding block means.

5. The roller apron as defined in claim 2, wherein:

each of said traverses contain at least three rolls;

means for movably guiding the intermediate roll of the upper traverse transversely with respect to the continuously cast strand;

pressurized fluid medium cylinder means for positionally adjusting said intermediate roll; and the adjustable intermediate roll comprising a driven roll.

6. The roller apron as defined in claim 5, wherein:

a roll opposite said adjustable intermediate roll is provided and constitutes a driven roll.

* * * * *